US006338635B1

(12) United States Patent
Lee

(10) Patent No.: US 6,338,635 B1
(45) Date of Patent: Jan. 15, 2002

(54) ELECTRICAL CONNECTOR WITH IMPROVED GROUNDING BUS

(75) Inventor: Wei-Chen Lee, Fremont, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/629,647

(22) Filed: Aug. 1, 2000

(51) Int. Cl.[7] ..... H04R 4/66
(52) U.S. Cl. ..... 439/108; 439/608
(58) Field of Search ..... 439/108, 101, 439/608

(56) References Cited

U.S. PATENT DOCUMENTS 5,536,179 A * 7/1996 Olsson et al. ..... 439/108
5,645,436 A * 7/1997 Shimizu et al. ..... 439/608
5,664,968 A * 9/1997 Mickievicz ..... 439/608
5,730,609 A * 3/1998 Harwath ..... 439/608

* cited by examiner

*Primary Examiner*—Gary F. Paumen
(74) *Attorney, Agent, or Firm*—Wei Te Chung

(57) ABSTRACT

An electrical connector comprises a housing 10, a number of terminals 20, and a number of modules 40. The modules each connect with an external ground circuit. Each module has a number of grounding members 42 insert molded with an insulative body 44. The insulative body defines a mounting surface 445 against which the terminals are mounted and forms a number of ribs 441 on the mounting surface. Each grounding member includes a flat plate 421 molded with the insulative body and a plurality of projections 425 protruding from the flat plate into the insulative body. The projections are adjustable in distance of protrusion beyond the mounting surface allowing the shielding effect they provide between adjacent terminals to be varied, controlling crosstalk therebetween. The ribs of the insulative body are also adjustable in length and thickness, allowing them to be manufactured to match the impedance of the connector with the characteristic impedance of a circuit board on which the connector is to be mounted.

1 Claim, 7 Drawing Sheets

ELECTRICAL CONNECTOR WITH IMPROVED GROUNDING BUS

BACKGROUND OF THE INVENTION

1. Field of the Invention

The present invention relates to an electrical connector, and particularly to a high speed electrical connector having an improved grounding bus.

2. Brief Description of the Prior Art

High speed connectors often include a grounding bus closely associated with signal terminals to promote high quality signal transmission therethrough. U.S. Pat. No. 5,536,179 discloses a conventional high speed connector, which comprises a dielectric housing, a module inserted in the housing which consists of a row of metal plates which is insert molded with an insulative body therearound, and two rows of signal contacts mounted respectively on opposite exterior sides of the insulative body. The insulative body usually forms a plurality of equally distanced dielectric ribs for isolating the signal contacts from each other. Each row of signal contacts is isolated from the other row by the insulative body and the metal plates, and signal contacts in the same row are isolated from each other by the dielectric ribs. With such a design, crosstalk between the two rows of the signal contacts is reduced by the insulative body and the metal plates, while crosstalk between the adjacent signal contacts of the same row cannot be effectively minimized merely by the dielectric ribs.

Hence, an improved electrical connector is required to overcome the disadvantage of the prior art.

BRIEF SUMMARY OF THE INVENTION

A first object of the present invention is to provide an electrical connector with an improved module which has a plurality of conductive projections located between adjacent signal terminals for minimizing crosstalk therebetween;

A second object of the present invention is to provide an electrical connector with an improved module which has a plurality of dielectric ribs the length of which can be adjusted to match the impedance of the connector with the characteristic impedance of a circuit board on which the connector is mounted.

To achieve the above-mentioned objects, an electrical connector of the present invention includes a dielectric housing, a plurality of terminals, and a module.

The module includes a plurality of grounding members insert molded with an insulative body. A plurality of ribs is provided on a mounting surface of the insulative body. Each grounding member has a flat plate, a finger outwardly and downwardly extending from the flat plate, and a plurality of equally distanced projections protruding from the flat plate into the insulative body. The projections extend beyond the mounting surface of the insulative body and are embedded within corresponding ribs.

In assembly, the module is inserted downwardly into the housing and then the terminals are inserted upwardly to a position on the mounting surface of the insulative body of the module such that each terminal is positioned between neighboring ribs.

Since the insulative body is insert molded with the grounding members, its thickness can be minimized to enable the grounding members to be as close as possible to the terminals. The projections of the grounding members extend beyond the mounting surface of the insulative body to a position between the terminals, thereby significantly minimizing crosstalk between the terminals.

In addition, the ribs of the insulative body can be shortened during manufacturing so that the impedance of the connector can be adjusted to match the characteristic impedance of the circuit board on which the connector is mounted.

Other objects, advantages and novel features of the present invention will become more apparent from the following detailed description of the present embodiment when taken in conjunction with the accompanying drawings.

DETAILED DESCRIPTION OF THE INVENTION

Figure 1:
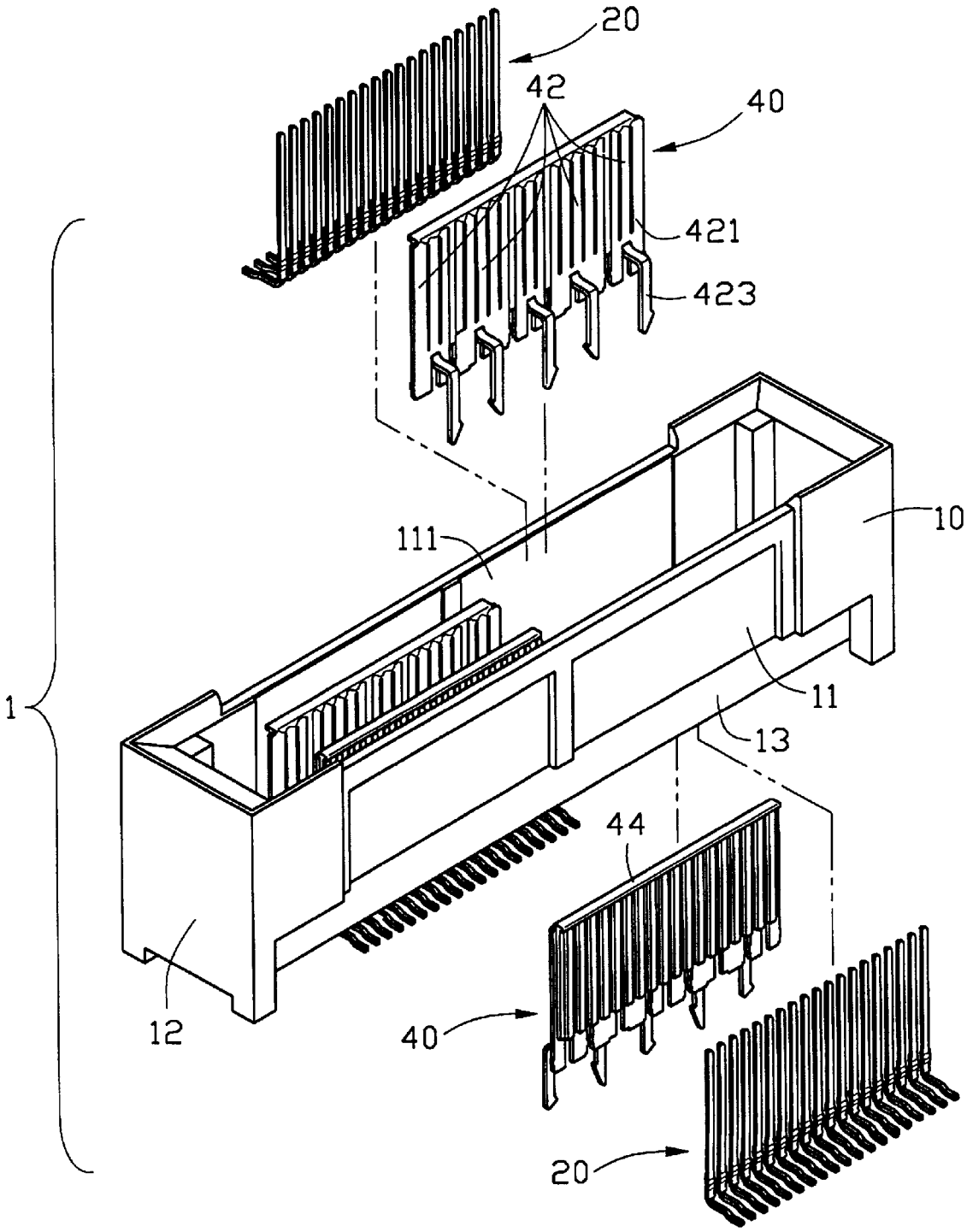
FIG. 1 is a partially exploded view of an electrical connector in accordance with the present invention.

Referring to FIG. 1, an electrical connector 1 of the present invention comprises a dielectric housing 10, a plurality of L-shaped terminals 20 arranged in four rows, and four modules 40 received in the housing 10 corresponding to the four rows of terminals 20.

The housing 10 has a pair of opposite sidewalls 11 and a pair of opposite end walls 12 extending upward from a base 13 thereof, thereby forming a cavity 111 therebetween. The base 13 defines a plurality of first passageways 134 and second passageways 135 (see FIGS. 7 and 8) arranged in rows in communication with the cavity 111. The housing 10 further defines a plurality of vertical recesses (not shown) for guiding insertion of the modules 40 and maintaining the modules 40 in position.

Figure 2:
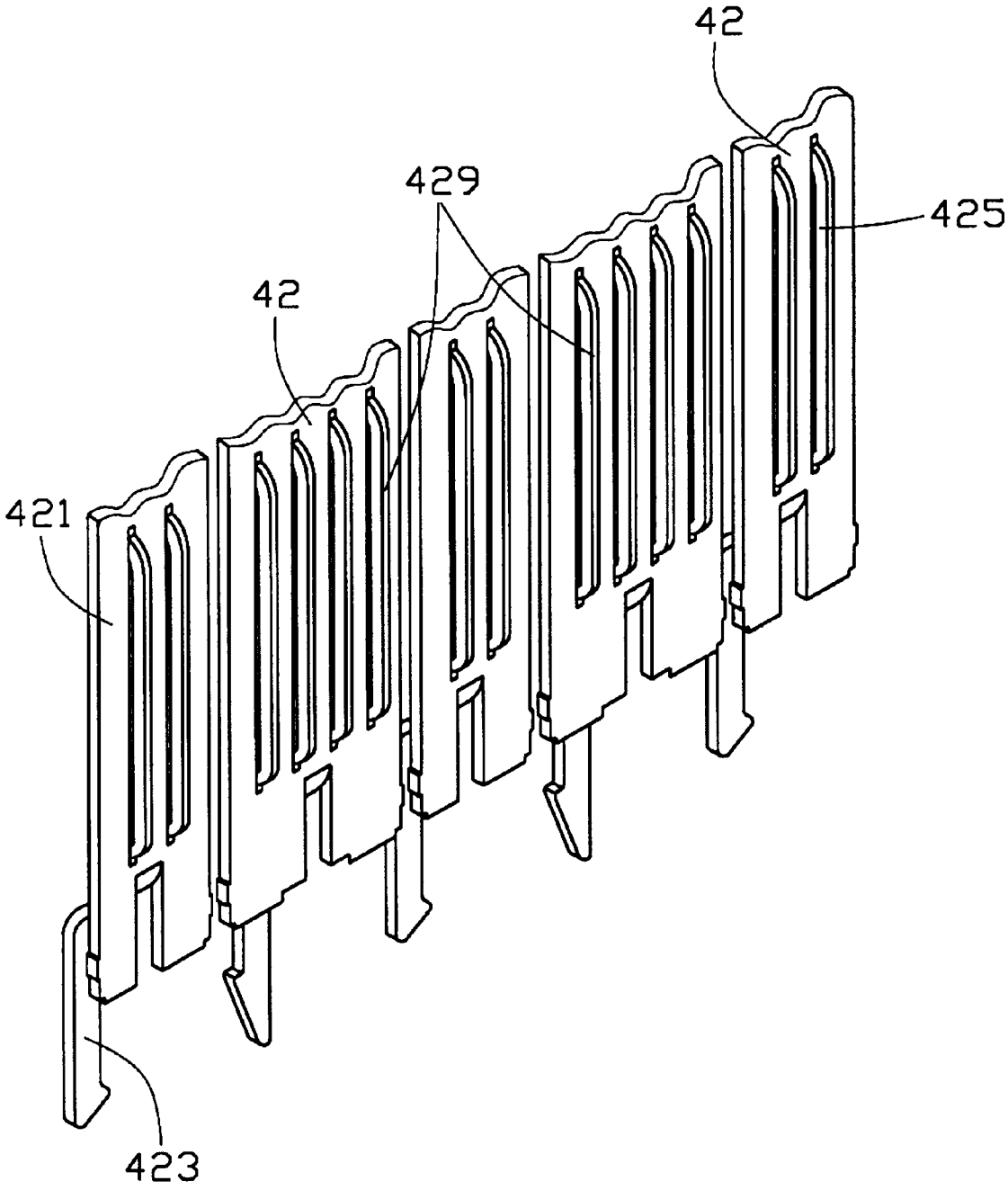
FIG. 2 is a rear perspective view of a grounding bus consisting of a plurality of grounding members shown in FIG. 1.

Each module 40 comprises a plurality of grounding members 42 insert molded with a T-shaped insulative body 44. FIG. 2 shows a grounding bus (not labeled) consisting of the grounding members 42. The grounding members 42 are isolated from each other and each has a flat plate 421, an L-shaped finger 423 protruding outwardly and downwardly from a front side of the flat plate 421, and a plurality of projections 425 protruding outwardly from a rear side of the flat plate 421. The insulative body 44 maintains the isolated grounding members 42 in alignment with each other such that the flat plates 421 thereof are contained in the same plane. The fingers 423 are for connecting with an external ground circuit of a circuit board (not shown) on which the connector 1 is mounted. The projections 425 of each grounding member 42 are spaced from each other at equal intervals. Each projection 425 extends from near a top edge of a corresponding flat plate 421 to a portion near the top end of a corresponding finger 423.

Figure 3:
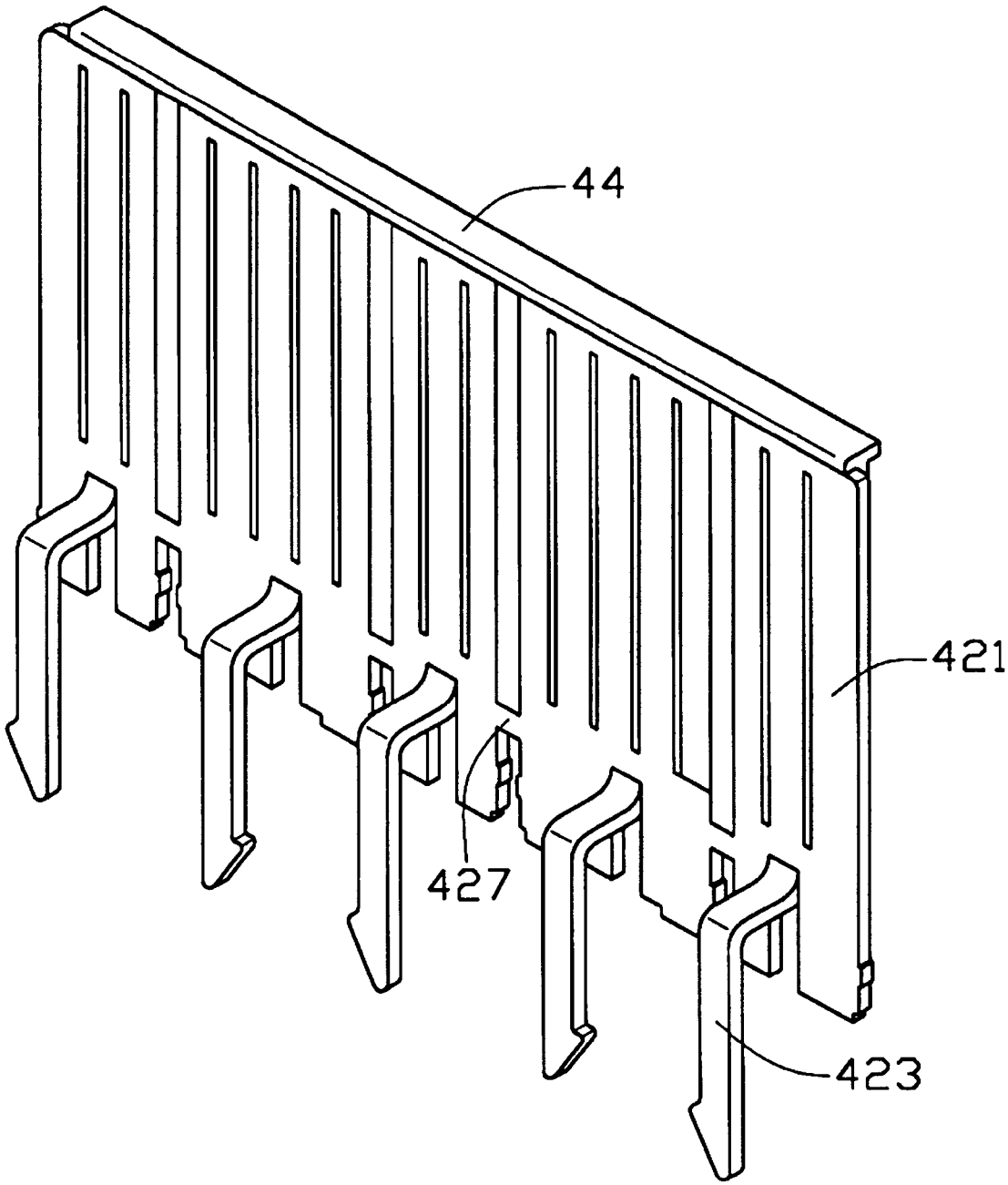
FIG. 3 is a perspective view of an alternative integral module.

Alternatively, as shown in FIG. 3, the grounding members 42 may be interconnected by bridges 427 into one integral grounding bus (not labeled).

Figure 4:
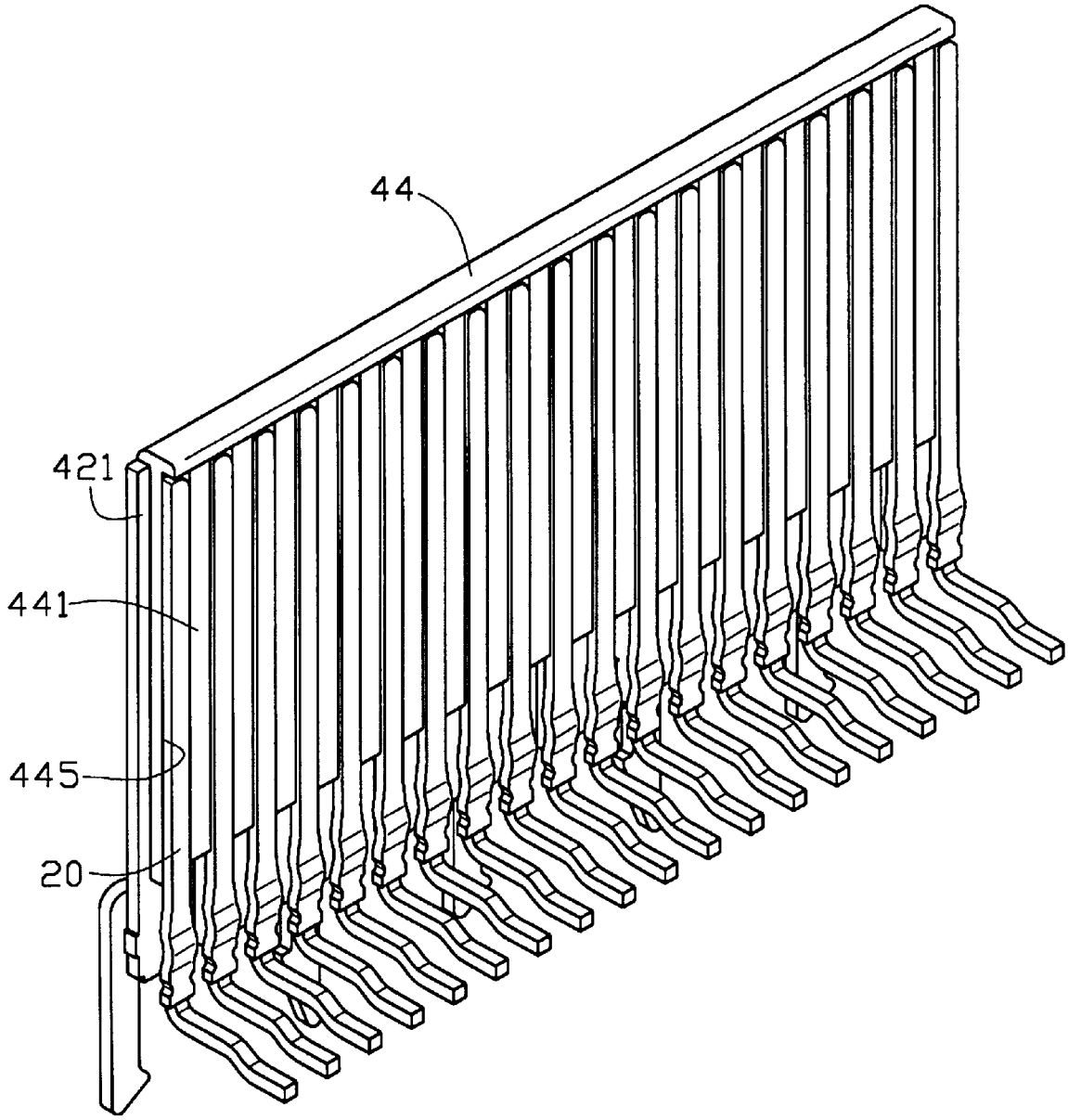
FIG. 4 is a rear perspective view of the module of FIG. 1 with terminals mounted thereto.
Figure 5:
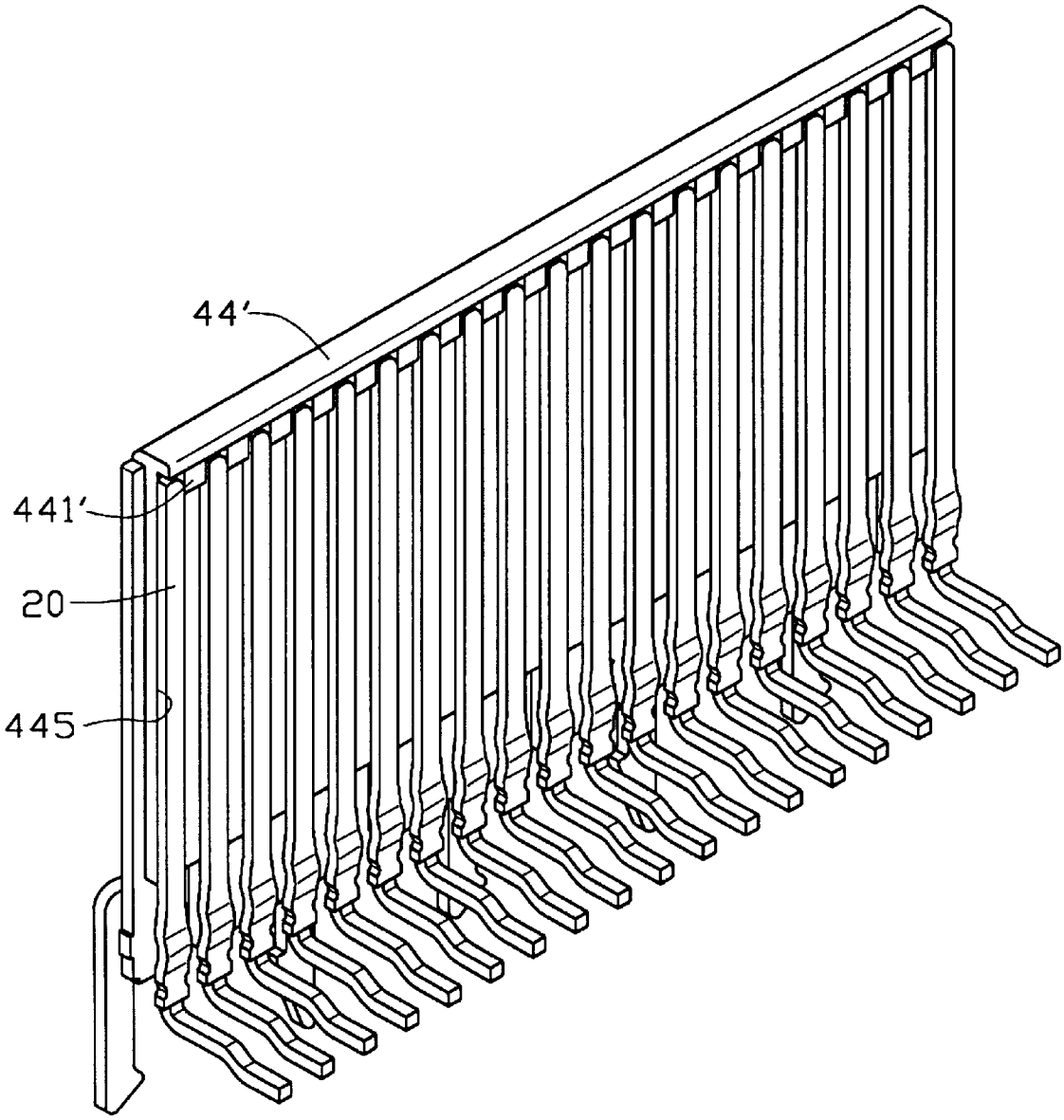
FIG. 5 is a view similar to FIG. 4 but with ribs thereof shortened.

FIG. 4 shows a rear side of the module 40 with the terminals 20 positioned thereon. The insulative body 44 forms a plurality of equally distanced ribs 441 projecting rearwards from a mounting surface 445 of the insulative body 44 for retaining the terminals 20 therebetween. The projections 425 of the grounding members 42 are embedded in corresponding ribs 441. The thickness of the insulative body 44 and the size of the ribs 441 can be adjusted to match the impedance of the connector 1 with the characteristic impedance of the circuit board on which the connector 1 is mounted. FIG. 5 illustrates an alternative insulative body 44' which has shortened ribs 441' for positioning the terminals 20 therebetween. Adjusting lengths (that is, the vertical dimension) of the ribs 441' adjusts the impedance of the connector 1 to match the characteristic impedance of the circuit board on which the connector 1 is mounted.

Figure 6:
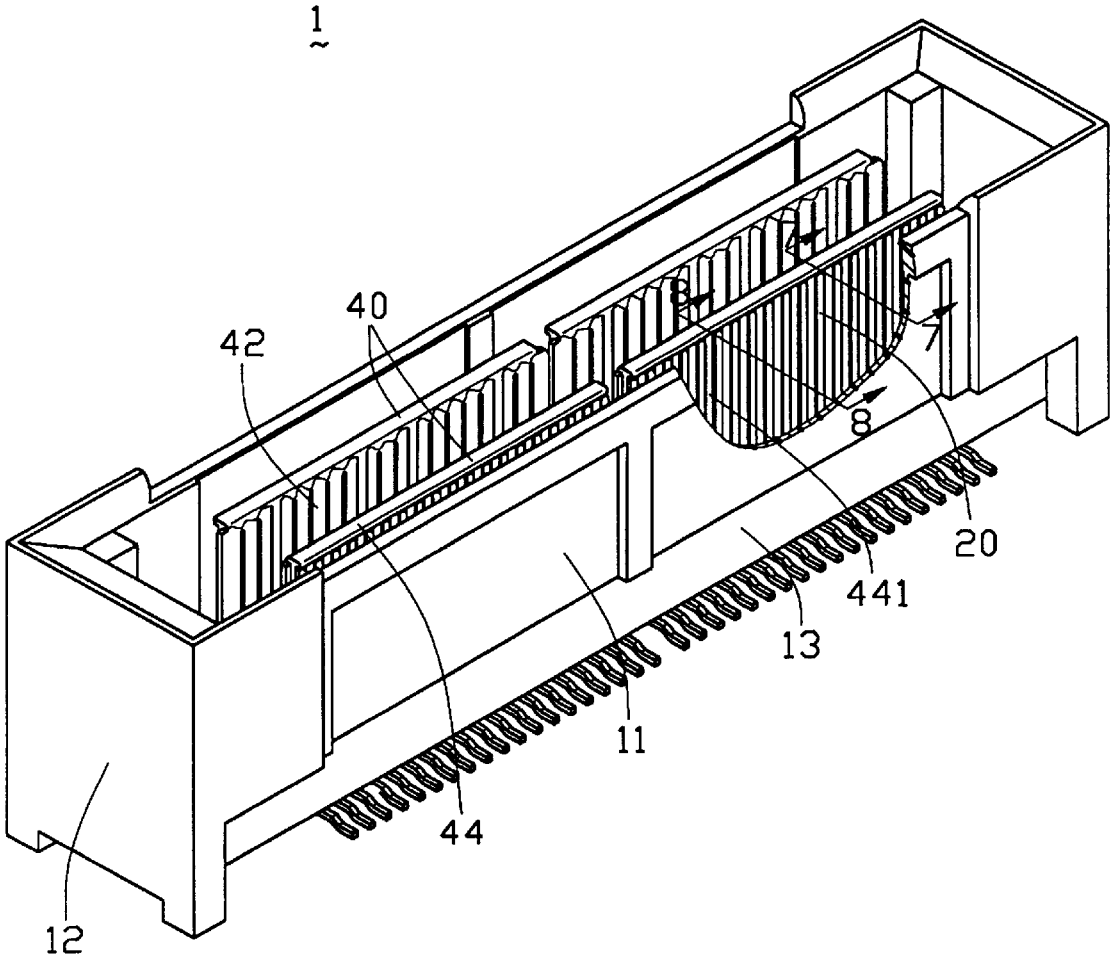
FIG. 6 is an assembled view of FIG. 1.
Figure 7:
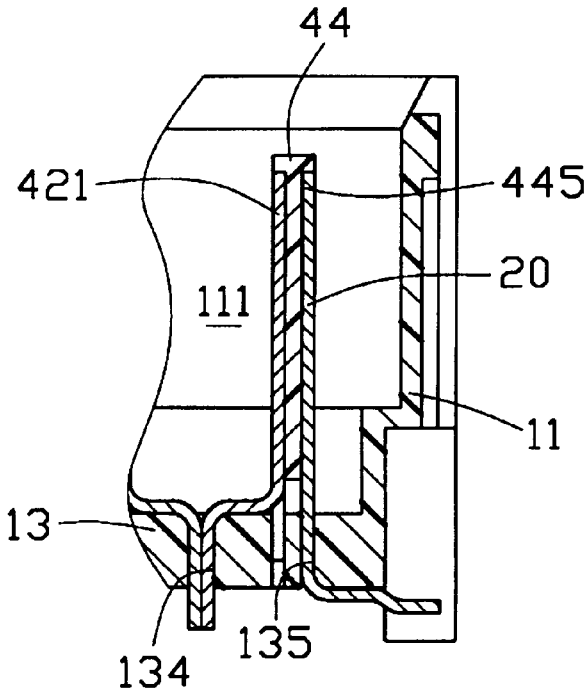
FIG. 7 is a cross-sectional view taken along line 7—7 of FIG. 6.
Figure 8:
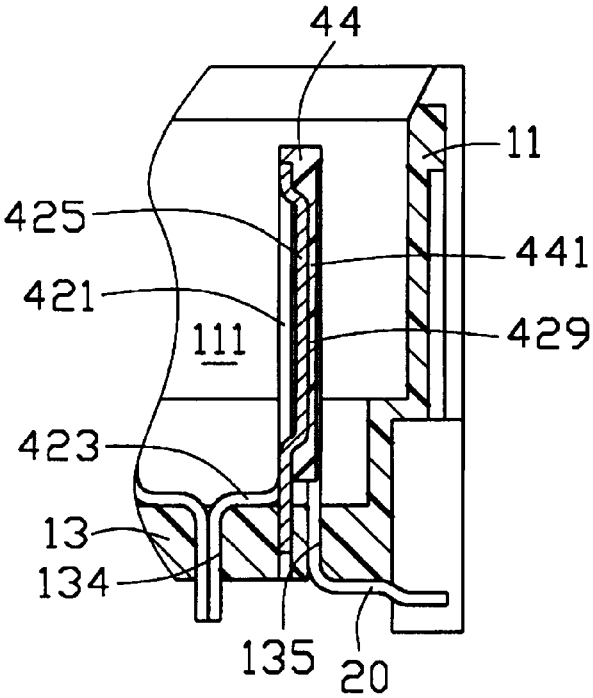
FIG. 8 is a cross-sectional view taken along line 8—8 of FIG. 6.

In assembly, also referring to FIGS. 6, 7 and 8, the modules 40 are first downwardly inserted into the cavity 111 of the housing 10 whereby the fingers 423 extend into corresponding first passageways 134. The terminals 20 are then inserted upwardly from a bottom side of the base 13 through the second passageways 135 to locations between adjacent ribs 441 of the insulative body 44. The terminals 20 are positioned adjacent to the mounting surface 445. Furthermore, the grounding members 42 on opposite ends of the module 40 extend beyond opposite lateral edges of the insulative body 44 for providing the terminals 20 with improved electrical performance.

Since the grounding members 42 are insert molded with the insulative body 44, the thickness of the insulative body 44 located between the terminals 20 and the flat plates 421 can be minimized during manufacturing. Therefore, the grounding members 42 can be located as close as possible to the terminals 20 whereby the grounding effect is improved. Additionally, as is clearly shown in FIG. 8, the projections 425 of the grounding members 42 can protrude beyond the mounting surface 445 of the insulative body 44 and between the adjacent terminals 20, thereby significantly reducing crosstalk between the terminals 20. Alternatively, an engaging surface 429 of each projection 425 (see FIG. 2) may be substantially flush with the mounting surface 445 when the insulative body 44' forms the shortened ribs 441'. The distance that the engaging surfaces 429 of the projection 425 protrude beyond the mounting surface 445 is also adjustable for efficiently minimizing crosstalk between the terminals 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. An electrical connector for mounting on a circuit board, comprising:

an insulative housing;

a module mounted in the housing and including an insulative body and at least a grounding member positioned on a front side of the insulative body, the grounding member being connected to a ground circuit of the circuit board, the insulative body defining a mounting surface on a rear side thereof; and a plurality of terminals of the insulative housing including two adjacent terminals, located on the mounting surface of the insulative body, wherein the grounding member forms at least a projection extending into the insulative body toward the mounting surface;

wherein the projection extends from an upper edge of the insulative body to a lower edge of the insulative body;

wherein the insulative body further comprises at least a rib on the mounting surface thereof for positioning and separating the terminals;

wherein the projection protrudes beyond the mounting surface and is embedded within the rib thereby being located between the two adjacent terminals and minimizing the crosstalk between the adjacent terminals;

wherein the rib of the insulative body is adjustable in length and thickness during manufacturing thereof for adjusting the impedance of the connector to match the characteristic impedance of the circuit board;

wherein the projection extends into the insulative body beneath the rib and defines an engaging surface substantially flush with the mounting surface when the rib of the insulative body is shortened;

wherein the module comprises a plurality of grounding members which can be either isolated from each other or connected together.

* * * * *